US012612844B2

(12) United States Patent
Harive et al.

(10) Patent No.: US 12,612,844 B2
(45) Date of Patent: Apr. 28, 2026

(54) SYSTEMS AND METHODS FOR REAL TIME OIL TOOL ORIENTATION DETECTION

(71) Applicant: HALLIBURTON ENERGY SERVICES, INC., Houston, TX (US)

(72) Inventors: Kevin Scott Harive, Anchorage, AK (US); Thomas Burky, Mooresville, NC (US); Federico Rios Osorio, Alvarado, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 18/406,556

(22) Filed: Jan. 8, 2024

(65) Prior Publication Data

US 2025/0223891 A1 Jul. 10, 2025

(51) Int. Cl.
*E21B 43/119* (2006.01)
*E21B 43/117* (2006.01)
*E21B 47/16* (2006.01)

(52) U.S. Cl.
CPC ..... *E21B 43/117* (2013.01); *E21B 43/119* (2013.01); *E21B 47/16* (2013.01)

(58) Field of Classification Search
CPC ..... E21B 43/117; E21B 43/119; E21B 47/16
See application file for complete search history.

(56) References Cited

U.S. PATENT DOCUMENTS 4,943,210 A * 7/1990 Bailey, Jr. ..... E21B 47/047 417/40
5,964,294 A * 10/1999 Edwards ..... E21B 23/00 166/242.6
6,378,607 B1 4/2002 Ryan et al.
8,439,114 B2 5/2013 Parrott et al.
9,945,215 B2 4/2018 Godfrey
11,131,168 B2 * 9/2021 Badii ..... E21B 43/119
2003/0102162 A1 * 6/2003 Sloan ..... E21B 43/119 175/4.51
2011/0132607 A1 * 6/2011 Lahitette ..... E21B 47/13 166/55.1
2012/0193143 A1 8/2012 Hill et al.
2017/0009563 A1 1/2017 Holder
2019/0391291 A1 12/2019 Milne et al.
2020/0386085 A1 12/2020 Badii et al.
2022/0136373 A1 5/2022 Bryant et al.
2023/0203923 A1 6/2023 Eitschberger
2023/0304384 A1 9/2023 Rajaram et al.
2024/0401441 A1 * 12/2024 Anthony ..... E21B 43/1185

FOREIGN PATENT DOCUMENTS

WO 2022/155497 A1 7/2022

OTHER PUBLICATIONS

International Search Report; dated Sep. 30, 2024; Application # PCT/US24/10676.

* cited by examiner

*Primary Examiner* — D. Andrews
(74) *Attorney, Agent, or Firm* — Polsinelli PC

(57) ABSTRACT

A perforating gun system for tubing conveyed perforation is provided. The perforating gun system includes a gun carrier, at least one free rotation device, a charge tube suspended on the at least one free rotation device, a stationary emitter coupled to the charge tube, and a sensor coupled to an interior surface of the gun carrier. The sensor can be configured to intermittently align with the stationary emitter when the charge tube is orienting independently of the rotation of the gun carrier.

16 Claims, 3 Drawing Sheets

SYSTEMS AND METHODS FOR REAL TIME OIL TOOL ORIENTATION DETECTION

FIELD

The present disclosure relates generally to perforating gun systems for tubing conveyed perforating. In at least one example, the present disclosure relates to an emitter and a sensor for detecting the position of a charge tube in a gun carrier of a perforating gun system.

BACKGROUND

In perforating gun systems for tubing conveyed perforating, it may be desirable to have charge tubes that orient independently of a rotation of a gun carrier, such that the charge tube can self-orient when the perforating gun system is downhole. By allowing the charge tube to self-orient, an exact set positioning of the charge tube before the perforating gun system is placed downhole is not necessary. Such charge tubes are installed on at least one free rotation device on an interior surface of the gun carrier. It may be desirable to determine the orientation and/or motion, in real time, of the charge tube using an emitter and one or more sensors before firing the charge tube.

BRIEF DESCRIPTION OF THE DRAWINGS

Implementations of the present technology will now be described, by way of example only, with reference to the attached figures, wherein.

DETAILED DESCRIPTION

Figure 1:
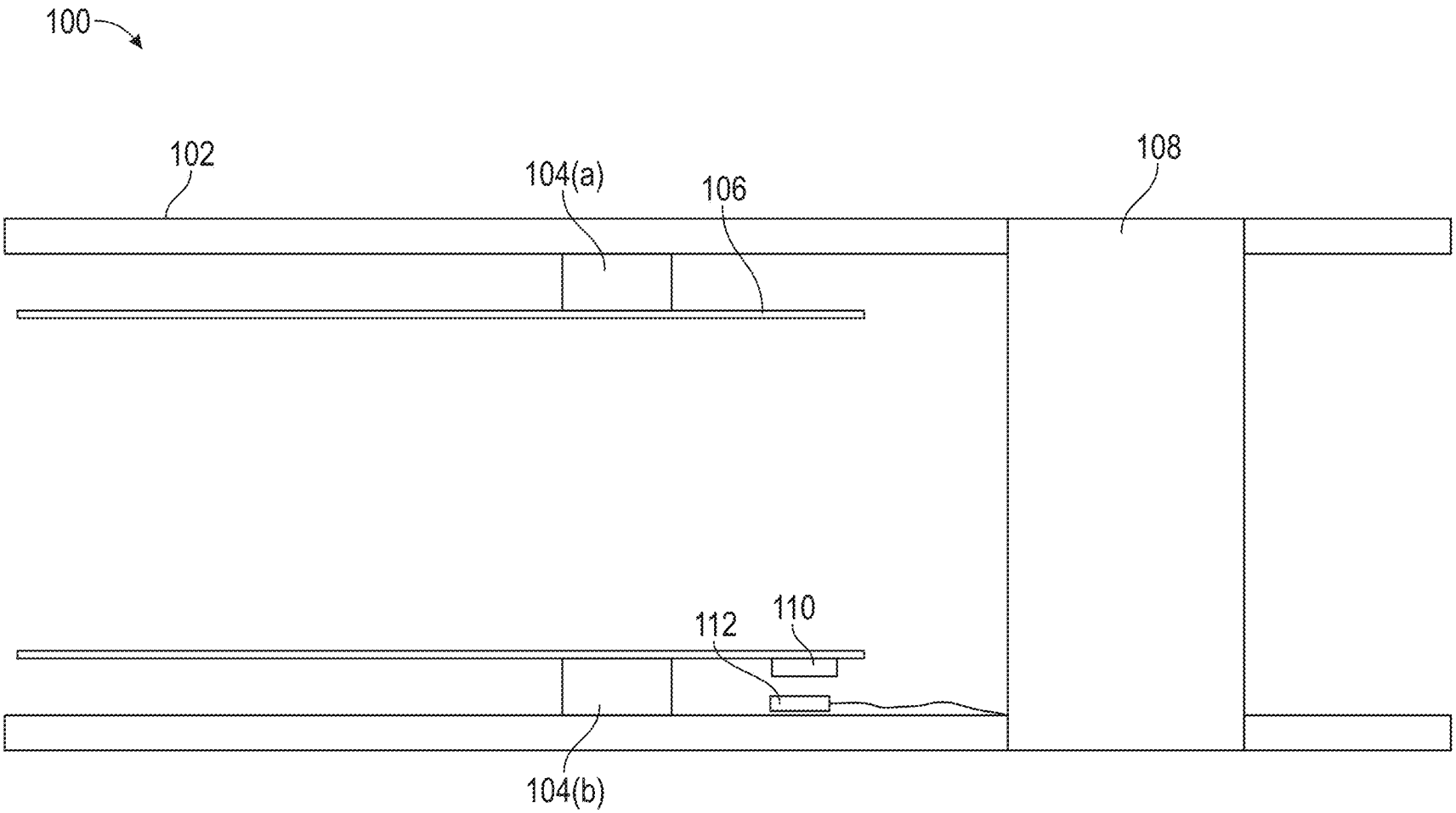
FIG. 1 illustrates a perforating gun system having a gun carrier and a charge tube.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be obvious from the description, or can be learned by practice of the principles disclosed herein. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Disclosed herein is a perforating gun system for tubing conveyed perforating. The perforating gun system can have a charge tube which is configured to self-align by gravitational forces in deviated wells or other locations where a perforating gun system can be used. It can be beneficial to determine the position of the charge tube before firing the perforating gun system to ensure that the charge tube is firing in the desired orientation. In another example, it can be sufficient to simply determine that the charge tube is orienting independently (e.g., rotating freely) within a gun carrier of the perforating gun system. If the charge tube is orienting independently of the rotation the gun carrier, it can be ensured that the charge tube is properly oriented at the time of firing. A stationary emitter and a sensor can be used to determine whether the charge tube is orienting independently of the rotation of the gun carrier. The stationary emitter and sensor can be in communication with an acoustic transmitter operable to emit an acoustic signal to an acoustic receiver. The acoustic receiver can be operable to display or otherwise notify an operator of the status (i.e., orientation or relative motion) of a charge tube in real time.

Tubing conveyed perforation is a process where a long string of tubes holding charges are placed in a wellbore. It is often desirable for the charges to be oriented in specific directions such that a desired explosion is achieved. In many tubing conveyed perforation cases, the charges are placed in a set configuration (i.e., stationary with respect to the tubing) within the tubing and then the tube is placed in the wellbore. However, it can be desirable for charge tubes to orient while they are in the wellbore. When charge tubes have the ability to independently orient while in a wellbore, it is difficult to determine if the charge tubes are independently orienting or whether the charge tubes have fouled (e.g., are not orienting properly). It can be expensive when charge tubes are not properly oriented causing explosions in the wrong directions. Therefore, there is a need for determining whether the charge tube is correctly orienting and determining a rotational position of a charge tube to ensure that the charge tubes are blown in the proper direction.

As illustrated in FIG. 1, the perforating gun system 100 can include a gun carrier 102 and a charge tube 106 within the gun carrier 102. The gun carrier 102 can be a pressurized housing. The perforating gun system 100 can include at least one free rotation device operable to allow a charge tube 106 to orient independently (e.g., freely rotate) with respect to the gun carrier 102. The at least one free rotation device can be one or more ball bearings, roller bearings, other bearings, other devices operable to allow an object to rotate freely, or combinations thereof. In some examples, the at least one free rotation device can be a plurality of roller bearings 104(*a*), 104(*b*) that are operable to contact an interior surface of the gun carrier 102. The charge tube 106 can be suspended on the at least one free rotation device (e.g., plurality of roller bearings 104(*a*), 104(*b*)). In some examples, the at least one free rotation device can be coupled to the interior surface of the gun carrier 102. The charge tube 106 can be configured to carry explosives (i.e., a charge). A stationary emitter 110 can be coupled to the charge tube 106. A sensor 112 can be coupled to an interior surface of the gun carrier 102. The sensor 112 and the stationary emitter 110 can both be located at a set position (i.e., distance) along the length of the gun carrier 102 such that the sensor and the stationary emitter 110 can align.

The charge tube 106 can have one or more counterweights. The one or more counterweights can be operable to orient the charge tube 106 to a desired orientation. The charge tube 106 is suspended on the at least one free rotation device (e.g., roller bearings 104(*a*), 104(*b*)), thereby allowing the charge tube 106 to rotate freely and orient independently from the orientation of the gun carrier 102. The counterweights are configured to orient based on gravitational forces. For example, if the desired orientation is for the charge tube 106 to point directly upward, the counterweights will be placed on a side of the charge tube 106 directly opposite of the charge. In this manner, the counterweights will be forced by gravity to the lowest position possible and the charge will face directly upwards. Other orientations of the charge tube 106 can similarly be achieved. The location of the counterweights can position the charge in the charge tube 106 at any orientation by locating the counterweights at a certain angle around the circumference of the charge tube 106 from the charge. In this manner, the charge tube 106 can be configured to fire in any desired direction. For example, defining 0 degrees as a straight upward orientation and 180 degrees as a straight downward direction, if the desired orientation of the charge is 90 degrees, the counterweights can be located 90 degrees from the charge along the circumference of the charge tube 106 (i.e., 180 degrees when positioned by gravitational forces such that the charge faces 90 degrees).

The positioning of the charge tube 106 using the counterweights can be understood using clock positions as a reference. The clock positions used correspond to positions when looking into the interior of the perforating gun system 100 from an end of the perforating gun system 100 (i.e., looking directly at the acoustic transmitter 108). The location of the counterweights should be at a 6 o'clock position (straight downward) when provided a gravitational force and when the charge tube 106 is orienting independently of the gun carrier 102, therefore the relation (e.g., angle) between the charge and the counterweights must be changed to orient the charge tube 106 in the desired position. For example, if the desired orientation of the charge is in a 3 o'clock direction then the counterweights should be located 3 hours clockwise from the charge on the charge tube 106. If the desired orientation of the charge is in the 9 o'clock position, then the counterweights should be located 3 hours counterclockwise (or 9 hours clockwise) from the charge on the charge tube 106. It will be appreciated that any desired orientation of the charge in the charge tube 106 can be accomplished in this manner.

The charge tube 106 can be erroneously prevented from rotating or orienting independently of the gun carrier 102 for various reasons. For example, the at least one free rotation device (e.g., plurality of roller bearings 104(*a*), 104(*b*)) may become dirty, jammed, or otherwise inoperable to allow the charge tube 106 to rotate. When the charge tube 106 is not freely rotating or orienting properly, the charge can be fired in an improper orientation thereby causing unwanted damage and/or requiring another system to be placed downhole to create the desired explosion. These improper orientations of the charge tube 106 can be expensive mistakes, therefore it is desirable to ensure that the charge tube 106 is correctly oriented before firing the perforating gun system 100.

The stationary emitter 110 can be located on an exterior surface of the charge tube 106. The sensor 112 can be located on an interior surface of the gun carrier 102 and be in communication with the acoustic transmitter 108. In an example, the stationary emitter 110 can be a magnet and the sensor 112 can be a reed switch. In other examples, the stationary emitter 110 and sensor 112 can be any kind of proximity emitter/sensor configuration (e.g., light emitter and photodiode sensors, etc.) such that the sensor 112 senses the stationary emitter 110 any time the stationary emitter 110 aligns with the sensor. After the gun carrier 102 is properly positioned in the well, the gun carrier 102 can be rotated. As the gun carrier 102 is rotated, the charge tube 106 will independently orient on the at least one free rotation device (e.g., roller bearings 104(*a*), 104(*b*)) due to the gravitational force on the counterweights. The sensor 112 can intermittently align with the stationary emitter 110 as the gun carrier 102 is rotated. When the sensor 112 is intermittently aligning with the stationary emitter 110, it can be confirmed that the charge tube 106 is independently orienting on the at least one free rotation device (e.g., plurality of roller bearings 104(*a*), 104(*b*)). If the sensor 112 is not intermittently aligning with the stationary emitter 110, it can be determined that the charge tube 106 is not independently orienting (i.e., the charge tube 106 is stuck at a set rotational position within the gun carrier 102).

The sensor 112 can be wired to the acoustic transmitter 108 or can be in wireless communication with the acoustic transmitter 108. The acoustic transmitter 108 can be configured to send an acoustic signal to an acoustic receiver at the surface (i.e., at the entrance to the hole on the earth's surface). The acoustic transmitter 108 can send an acoustic signal to the acoustic receiver every time the sensor 112 aligns with the stationary emitter 110. The acoustic signal can inform an operator that the charge tube 106 is orienting independently from the gun carrier 102. When the charge tube 106 is not orienting independently of the gun carrier 102, the acoustic transmitter 108 can either send a constant acoustic signal (e.g., the sensor 112 and the stationary emitter 110 are aligned and not moving with respect to one another) or no acoustic signal (e.g., the sensor 112 and the stationary emitter 110 are not aligned and not moving with respect to one another) for a predetermined period of time (i.e., the amount of time it takes to fully rotate the gun carrier 360 degrees). In this manner, it can be determined that the charge tube 106 is not orienting independently of the rotation of the gun carrier 102. The acoustic transmitter 108 can provide acoustic signals in real-time, thereby allowing real time evaluation of the independent orientation, or lack thereof, of the charge tube 106 with respect to the gun carrier 102.

The acoustic transmitter 108 can also function as a firing head. The acoustic receiver can send a signal to the acoustic transmitter 108 to fire the charge tube 106 via a detonation cord, thereby causing the charge in the charge tube 106 to fire. The gun carrier 102 can have a hole (e.g., perforation) where the charge of the charge tube 106 is directed. In this manner the charge can fire unimpeded in the desired orientation.

Figure 2:
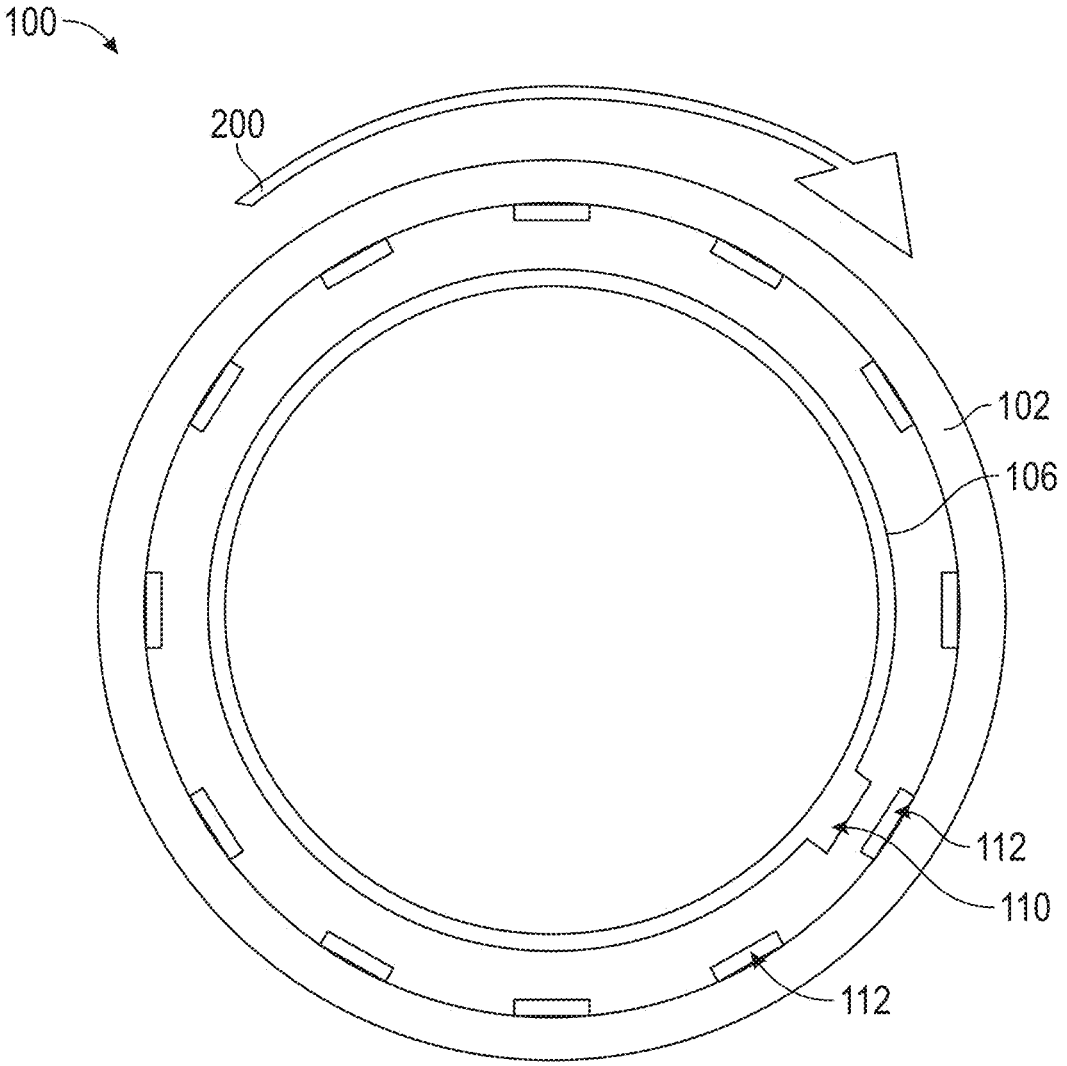
FIG. 2 illustrates an end view of a gun perforating system having a gun carrier and a charge tube.

As illustrated in FIG. 2, the perforating gun system 100 can have more than one sensor 112 on the interior surface of the gun carrier 102. In some examples, the perforating gun system 100 can have one, two, three, four, five, six, seven, eight, nine, ten, eleven, twelve, thirteen, fourteen, fifteen, sixteen, seventeen, eighteen, nineteen, twenty, or more sensors. The sensors 112 can be spaced around a circumference of the interior surface of the gun carrier 102 at a predetermined distance along the length of the gun carrier (e.g., the sensors 112 and the stationary emitter 110 are both at the same distance along the length of the gun carrier 102). The predetermined distance can be any distance along the length of the gun carrier so long as the sensors 112 and the stationary emitter 110 are located at the same distance along the length of the gun carrier 102. Each additional sensor can be configured to intermittently align with the stationary emitter 110 when the charge tube 106 is orienting independently of the rotation of the gun carrier 102. The additional sensors can all be in communication with the acoustic transmitter 108.

The acoustic transmitter 108 can transmit a unique acoustic signal (i.e., identifier) for each of the sensors 112 to the acoustic receiver. When the gun carrier 102 is rotated, as shown by arrow 200, the stationary emitter 110 will align with (e.g., pass by) each of the sensors 112 if the charge tube 106 is orienting independently of the gun carrier 102. The rotational position of the charge tube 106 can be determined based on the unique identifiers of each sensor 112. When a unique acoustic signal for one of the sensors 112 is received at the acoustic receiver, the charge tube 106 rotational position is known (e.g., the stationary emitter 110 is aligned with the sensor 112 for which the unique acoustic signal was received). In this manner, the rotational position of the charge tube 106 can be determined using the position of the stationary emitter 110, the amount of rotation of the gun carrier 102, and the position of the sensor 112 with respect to the gun carrier 102 for which the unique acoustic signal is transmitted. In some examples, the position of the sensors 112 at a start position (i.e., before rotating the gun carrier 102) is known, thereby providing the exact rotational position of the stationary emitter 110, and thereby the charge tube 106.

In other examples, the position of the sensors 112 can be benchmarked against sensors in an adjacent perforating gun system or other reference point, thereby allowing the unique identifying signals to determine the rotational position of the charge tube 106. For example, if the charge tube 106 is not freely rotating (i.e., stuck charge tube) in the perforating gun system 100, the position of the stuck charge tube 106 can be determined utilizing the sensors in an adjacent perforating gun system. The adjacent gun carrier in the adjacent gun system is rotated at the same rate as the gun carrier 102. The acoustic transmitter 108 is transmitting a constant unique acoustic signal of a sensor 112, thereby indicating a stuck charge tube 106. The position of the adjacent gun systems sensors can be determined by the properly oriented adjacent charge tube. The positions of the adjacent gun system sensors, in conjunction with the benchmarked positional relationship of the sensors 112 to the adjacent system sensors, can be used to determine the rotational position of the stuck charge tube 106. For example, at a point in time a position of a sensor on the adjacent gun carrier will be known by passing the properly oriented adjacent charge tube. This adjacent system's sensor position can then be converted to the position of the sensor 112 giving off the constant acoustic signal from the stuck charge tube 106, thereby providing the position of the stuck charge tube 106 at a point in time. Utilizing the known rotation of the gun carrier 102 and the known position of the sensor 112 giving off the constant acoustic signal of the stuck charge tube 106 at the point in time, the rotational position of the stuck charge tube 106 can be known at any point in time (e.g., converting the known position at the point in time to a new position at a new point in time using the rotation rate of the gun carrier 102).

Determining the exact rotational position of the charge tube 106 in relation to the gun carrier 102 can be beneficial. For example, the rotational position of the charge tube 106 can inform an operator that the charge tube 106 is positioned to fire in the desired direction or can allow an operator to determine the extent of the misalignment of the charge tube 106. If the misalignment of the charge tube 106 is known, the operator can make a decision as to whether to fire the perforating gun system 100 with the charge tube 106 misaligned or pull the perforating gun system 100 out of the hole to inspect the misalignment.

Multiple perforating gun systems 100 can be chained together to form a gun string with multiple perforating gun systems 100 (i.e., perforating gun assemblies). In some examples, each acoustic transmitter 108 can be in communication with the acoustic transmitter 108 of the adjacent perforating gun systems 100. In another example, each acoustic transmitter 108 can transmit acoustic signals directly to an acoustic receiver. In another example, each acoustic transmitter 108 can have its own acoustic receiver. In other examples, the gun string can have a single acoustic transmitter 108 that is in communication with the sensor or sensors 112 in each gun carrier 102 of each perforating gun system 100 in the gun string.

Each sensor 112 in each gun carrier 102 can be given a unique acoustic signal, thereby allowing the operator to determine whether the charge tube 106 in each perforating gun system 100 is orienting independently of the rotation of the gun carrier 102. For example, the gun string may have two, three, four, five, six, seven, eight, nine, ten, ten to fifteen, fifteen to twenty, twenty to twenty-five, or more perforating gun systems 100. For each charge tube 106 in each perforating gun system 100, it can be determined whether the charge tube 106 is orienting independently of the rotation of the gun carrier 102. When one or more charge tubes 106 are not orienting independently of the rotation of the gun carrier 102, the operator can determine whether to fire the gun based on the number of misaligned charge tubes 106. Further, each perforating gun system 100 can have multiple sensors 112 operable to determine the rotation position of the charge tube 106 in each perforating gun system 100 as described herein. The actual rotational position of each charge tube 106 can allow an operator to determine how misaligned each charge tube 106 is and decide whether to fire the gun string.

Each acoustic transmitter 108 can be a firing head in the gun string. In the example where there is only a single acoustic transmitter 108 in communication with the sensors 112 in each perforating gun system 100, the single acoustic transmitter 108 can be a firing head for each perforating gun system. By utilizing only a single acoustic transmitter 108, the risks of mis-fire and the cost of the system can be reduced.

It will be appreciated that while the perforating gun system 100 described herein is for the use of tubing conveyed perforating, the perforating gun system 100 can be modified for use in other types of conveyances. For example, the sensor 112 and stationary emitter 110 in combination with the independently orienting charge tube 106 can be used with other types of conveyances such as wireline, slickline, and coiled tubing. In these other types of conveyances, a downhole actuator may be required to rotate the gun carrier 102 during conveyance or at depth in order to facilitate the detection of the charge tube position or motion.

Figure 3:
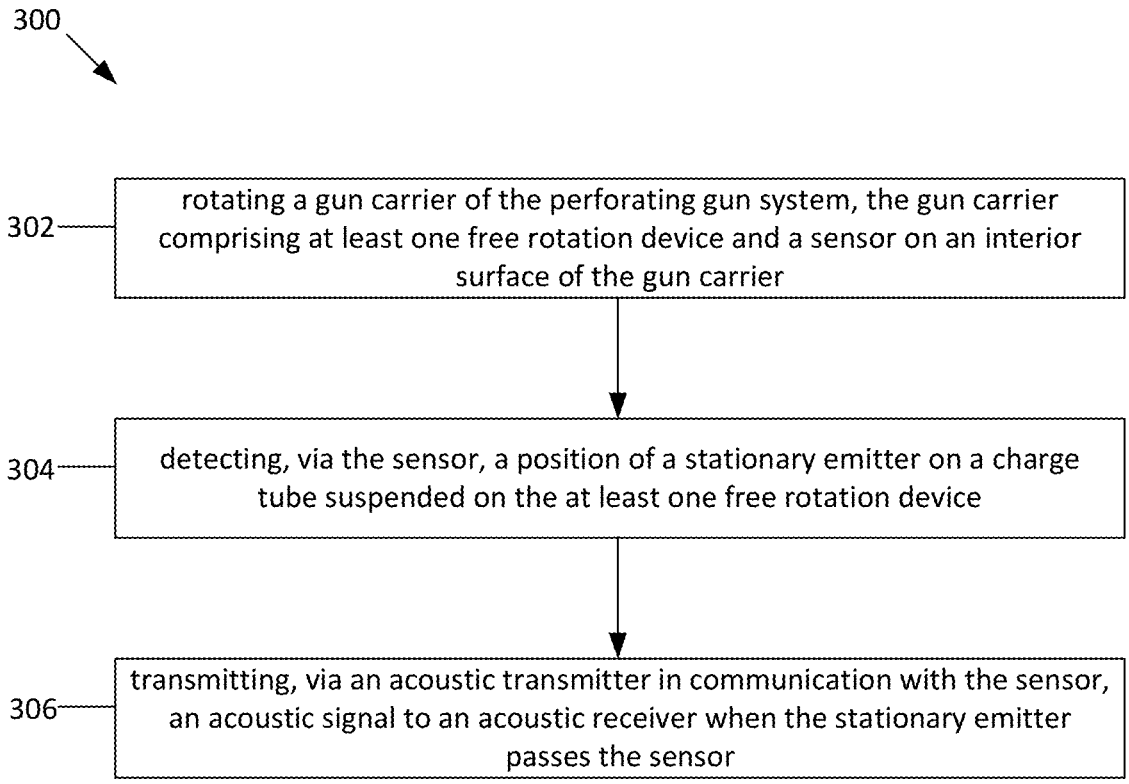
FIG. 3 illustrates a flowchart of a method for determining a position or motion of a charge tube in a perforating gun system.

Further provided herein is a method for determining a position or motion of a charge tube in a tubing conveyed perforating gun system. FIG. 3 illustrates an exemplary method 300 for determining the position or motion of a charge tube in a tubing conveyed perforating gun system. The method 300 can be conducted using the systems described herein.

The method 300 can include placing a perforating gun system downhole in a well or deviated well. The perforating gun system can be placed downhole utilizing systems and methods known in the art for moving a perforating gun system downhole.

At block 302, the method 300 can begin by rotating a gun carrier of a perforating gun system. The gun carrier can include at least one free rotation device (e.g., plurality of roller bearings, ball bearings, or other rotation devices) and a sensor on an interior surface of the gun carrier. In some examples, the at least one free rotation device (e.g., plurality of roller bearings) can be coupled to the interior surface of the gun carrier. In other examples, the at least one free rotation device (e.g., plurality of roller bearings) may simply be operable to contact the interior surface of the gun carrier.

At block 304, the method 300 can include detecting, via the sensor, a position of a stationary emitter on a charge tube suspended on the at least one free rotation device. The sensor can be a reed switch and the stationary emitter can be a corresponding magnet. In another example, the sensor and stationary emitter can be any proximity sensor/emitter pairing known in the art (e.g., light emitter and photodiode, etc.). The sensor and the stationary emitter can be positioned at a predetermined distance along a length of the gun carrier such that the sensor and the stationary emitter are configured to intermittently align. The charge tube can be configured to orient independently (e.g., freely rotate) on the at least one free rotation device in relation to the gun carrier. The charge tube can have one or more counterweights that allow a charge of the charge tube to be oriented due to gravitational force, as described herein.

At block 306, the method 300 can include transmitting, via an acoustic transmitter in communication with the sensor, an acoustic signal to an acoustic receiver when the stationary emitter passes the sensor. When the acoustic signal received at the acoustic receiver is a changing acoustic signal (e.g., a periodic signal), the charge tube is orienting independently of the rotation of the gun carrier. The changing acoustic signal is indicative that the charge tube is orienting independently and therefore the charge tube is oriented in the desired direction to fire. However, a constant acoustic signal or no acoustic signal for a predetermined period of time (e.g., the amount of time it takes to rotate the gun carrier 360 degrees) is indicative that the charge tube is not orienting independently of the rotation of the gun carrier. The constant acoustic signal or no acoustic signal for the predetermined period of time indicates to an operator that the charge tube is not orienting in the desired direction to fire.

The method can further include detecting, via one or more additional sensors spaced around a circumference of the interior surface of the gun carrier, the position of the stationary emitter on the charge tube suspended on the at least one free rotation device. The one or more additional sensors are also located at a predetermined distance along the length of the gun carrier such that the additional sensors are configured to align with the stationary emitter intermittently. The one or more additional sensors can be in communication with the acoustic transmitter. The acoustic transmitter can be configured to transmit unique signals for the sensor and each of the additional sensors. The unique acoustic signals can be configured to provide a rotational position of the charge tube relative to the gun carrier.

The method can be implemented on a single perforating gun system or on a gun string that includes multiple perforating gun systems as described herein.

Numerous examples are provided herein to enhance understanding of the present disclosure. A specific set of statements are provided as follows.

Statement 1: A perforating gun system for tubing conveyed perforating (TCP), the perforating gun system comprising: a gun carrier having an interior surface and operable to be rotated; at least one free rotation device operable to contact the interior surface of the gun carrier; a charge tube suspended on the at least one free rotation device, so that the charge tube can rotate with respect to the gun carrier; a stationary emitter coupled to the charge tube; and a sensor coupled to the interior surface of the gun carrier, wherein the sensor is configured to intermittently align with the stationary emitter when the charge tube is orienting independently of the rotation of the gun carrier.

Statement 2: The perforating gun system as disclosed in Statement 1, the perforating gun system further comprising an acoustic transmitter in communication with the sensor.

Statement 3: The perforating gun system as disclosed in Statement 2, wherein the acoustic transmitter is configured to output an acoustic signal to an acoustic receiver every time the stationary emitter aligns with the sensor.

Statement 4: The perforating gun system as disclosed in Statements 2 or 3, wherein when the charge tube is not orienting independently of the rotation of the gun carrier the acoustic transmitter outputs a constant acoustic signal or no acoustic signal.

Statement 5: The perforating gun system as disclosed in any of preceding Statements 1-4, wherein the charge tube comprises one or more counterweights such that the charge tube is positioned by gravitation forces within the gun carrier.

Statement 6: The perforating gun system as disclosed in Statement 5, wherein when the gun carrier is rotated the charge tube remains in a desired orientation due to gravitational forces.

Statement 7: The perforating gun system as disclosed in any of preceding Statements 1-6, wherein the stationary emitter is a magnet, and the sensor is a reed switch.

Statement 8: The perforating gun system as disclosed in any of preceding Statements 1-7, wherein the perforating gun system further comprises one or more additional sensors spaced, at a predetermined distance, around a circumference of the interior surface of the gun carrier.

Statement 9: The perforating gun system as disclosed in Statement 9, wherein the one or more additional sensors are configured to provide a rotational position of the charge tube within the gun carrier based upon the location of the emitter relative to the sensor and one or more sensors.

Statement 10: A method for determining a position or motion of a charge tube in a tubing conveyed perforating (TCP) gun system, the method comprising: rotating a gun carrier of the perforating gun system, the gun carrier comprising at least one free rotation device and a sensor on an interior surface of the gun carrier; detecting, via the sensor, a position of a stationary emitter on a charge tube suspended on the at least one free rotation device; and transmitting, via an acoustic transmitter in communication with the sensor, an acoustic signal to an acoustic receiver when the stationary emitter passes the sensor.

Statement 11: The method as disclosed in Statement 10, wherein a changing acoustic signal is indicative that the charge tube is orienting independently of the rotation of the gun carrier.

Statement 12: The method as disclosed in Statements 10 or 11, wherein during a predetermined amount of time during rotation of the gun carrier, a constant acoustic signal or no acoustic signal is indicative that the charge tube is not orienting independently of the rotation of the gun carrier.

Statement 13: The method as disclosed in any one of Statements 10-12, the method further comprising detecting, via one or more additional sensors spaced around a circumference of the interior surface of the gun carrier, the position of the stationary emitter on the charge tube suspended on the at least one free rotation device.

Statement 14: The method as disclosed in Statement 13, wherein the one or more additional sensors are in communication with the acoustic transmitter.

Statement 15: The method as disclosed in Statement 14, wherein the acoustic transmitter transmits unique acoustic signals to the acoustic receiver for the sensor and each of the one or more additional sensors.

Statement 16: The method as disclosed in Statement 15, wherein the unique acoustic signals are configured to provide a rotational position of the charge tube relative to the gun carrier.

Statement 17: A perforating gun system for tubing conveyed perforating (TCP), the system comprising: a first perforating gun assembly, the first perforating gun assembly comprising: a first gun carrier having an interior surface and operable to be rotated; at least one free rotation device operable to contact the interior surface of the gun carrier; a first charge tube suspended on the at least one free rotation device of the first gun carrier, so that the first charge tube can rotate with respect to the gun carrier; a first stationary emitter coupled to the first charge tube; and at least one first gun carrier sensor coupled to the interior surface of the first gun carrier, the at least one first gun carrier sensor configured to intermittently align with the first stationary emitter when the first charge tube is orienting independently of the rotation of the gun carrier; a second perforating gun assembly coupled to a proximal end of the first perforating gun assembly, the second perforating gun assembly comprising: a second gun carrier having an interior surface and operable to be rotated; at least one free rotation device operable to contact the interior surface of the gun carrier; a second charge tube suspended on the at least one free rotation device of the second gun carrier, so that the charge tube can rotate with respect to the second gun carrier; a second stationary emitter coupled to the second charge tube; and at least one second gun carrier sensor coupled to the interior surface of the second gun carrier, the at least one second gun carrier sensor configured to intermittently align with the second stationary emitter when the second charge tube is orienting independently of the rotation of the second gun carrier; and an acoustic transmitter in communication with the at least one first gun carrier sensor and/or the at least one second gun carrier sensor, the acoustic transmitter configured to output an acoustic signal to an acoustic receiver.

Statement 18: The perforating gun system as disclosed in Statement 17, wherein the at least one first gun carrier sensor comprises one, two, three, four, five, or more sensors spaced around a circumference of the interior surface of the first gun carrier.

Statement 19: The perforating gun system as disclosed in Statements 17 or 18, wherein the at least one second gun carrier sensor comprises one, two, three, four, five, or more sensors spaced around a circumference of the interior surface of the second gun carrier.

Statement 20: The perforating gun system as disclosed in any one of Statements 17-19, the perforating gun system further comprising one or more additional perforating gun assemblies.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A perforating gun system for tubing conveyed perforating (TCP), the perforating gun system comprising:

a gun carrier having an interior surface and operable to be rotated;

at least one free rotation device operable to contact the interior surface of the gun carrier;

a charge tube suspended on the at least one free rotation device, so that the charge tube can rotate with respect to the gun carrier;

a stationary emitter coupled to the charge tube;

a plurality of sensors coupled to the interior surface of the gun carrier;

an acoustic transmitter in communication with the plurality of sensors;

wherein the plurality of sensors are configured to intermittently align with the stationary emitter when the charge tube is orienting independently of a rotation of the gun carrier, wherein each sensor of the plurality of sensors comprises a unique identifier, and wherein the acoustic transmitter is operable to transmit a unique acoustic signal based on the unique identifier for each sensor of the plurality of sensors when the stationary emitter aligns with each sensor of the plurality of sensors, and wherein the acoustic transmitter is a firing head.

2. The perforating gun system of claim 1, wherein when the charge tube is not orienting independently of the rotation of the gun carrier the acoustic transmitter outputs a constant acoustic signal or no acoustic signal.

3. The perforating gun system of claim 1, wherein the charge tube comprises one or more counterweights such that the charge tube is positioned by gravitational forces within the gun carrier.

4. The perforating gun system of claim 3, wherein when the gun carrier is rotated the charge tube remains in a desired orientation due to gravitational forces.

5. The perforating gun system of claim 1, wherein the stationary emitter is a magnet, and the plurality of sensors include reed switches.

6. The perforating gun system of claim 1, further comprising, a plurality of charge tubes each rotatable relative to each other and to the gun carrier; and a plurality of acoustic transmitters, each acoustic transmitter operable to transmit an orientation of a respective charge tube and detonate the respective charge tube.

7. The perforating gun system of claim 1, further comprising, a plurality of charge tubes each rotatable relative to each other and to the gun carrier, each charge tube adjacent each other to form a chain;

wherein the acoustic transmitter is operable to detonate the plurality of charge tubes.

8. A method for determining a position or motion of a charge tube in a perforating gun system for tubing conveyed perforating (TCP), the method comprising:

rotating a gun carrier of the perforating gun system, the gun carrier comprising at least one free rotation device and a plurality of sensors on an interior surface of the gun carrier;

detecting, via the plurality of sensors, the position of a stationary emitter on the charge tube suspended on the at least one free rotation device; and transmitting, via an acoustic transmitter in communication with the sensor, an acoustic signal to an acoustic receiver when the stationary emitter passes each sensor of the plurality of sensors; and firing, via the acoustic transmitter, the charge tube, wherein each sensor of the plurality of sensors comprises a unique identifier, and wherein the acoustic signal comprises a plurality of unique acoustic signals based on the unique identifier for each sensor of the plurality of sensors.

9. The method of claim 8, wherein a changing acoustic signal is indicative that the charge tube is orienting independently of the rotation of the gun carrier.

10. The method of claim 8, wherein during a predetermined amount of time during rotation of the gun carrier, a constant acoustic signal or no acoustic signal is indicative that the charge tube is not orienting independently of the rotation of the gun carrier.

11. The method of claim 8, the method further comprising detecting, via the plurality of sensors, the position of the stationary emitter on the charge tube suspended on the at least one free rotation device.

12. The method of claim 8, wherein the unique acoustic signals are configured to provide a rotational position of the charge tube relative to the gun carrier.

13. The method of claim 8, further comprising:

receiving, via the acoustic transmitter, a firing signal, wherein firing the charge tube via the acoustic transmitter includes igniting a detonation cord.

14. The method of claim 8, wherein the acoustic transmitter fires the charge tube based on the detected position of the stationary emitter on the charge tube.

15. A perforating gun system for tubing conveyed perforating (TCP), the perforating gun system comprising:

a first perforating gun assembly, the first perforating gun assembly comprising:

a first gun carrier having an interior surface and operable to be rotated;

at least one free rotation device operable to contact the interior surface of the first gun carrier;

a first charge tube suspended on the at least one free rotation device of the first gun carrier, so that the first charge tube can rotate with respect to the first gun carrier;

a first stationary emitter coupled to the first charge tube; and a plurality of first gun carrier sensors coupled to the interior surface of the first gun carrier, the plurality of first gun carrier sensors configured to intermittently align with the first stationary emitter when the first charge tube is orienting independently of a rotation of the first gun carrier;

a second perforating gun assembly coupled to a proximal end of the first perforating gun assembly, the second perforating gun assembly comprising:

a second gun carrier having an interior surface and operable to be rotated;

at least one free rotation device operable to contact the interior surface of the second gun carrier;

a second charge tube suspended on the at least one free rotation device of the second gun carrier, so that the second charge tube can rotate with respect to the second gun carrier;

a second stationary emitter coupled to the second charge tube; and a plurality of second gun carrier sensors coupled to the interior surface of the second gun carrier, the plurality of second gun carrier sensors configured to intermittently align with the second stationary emitter when the second charge tube is orienting independently of a rotation of the second gun carrier; and an acoustic transmitter in communication with the plurality of first gun carrier sensors and/or the plurality of second gun carrier sensors, the acoustic transmitter configured to output a unique acoustic signal for each sensor of the plurality of first gun carrier sensors and/or the plurality of second gun carrier sensors to an acoustic receiver, and wherein the acoustic transmitter is a firing head operable to fire at least one of the first or second charge tubes.

16. The perforating gun system of claim 15, the perforating gun system further comprising one or more additional perforating gun assemblies.

* * * * *